US011759722B2

(12) United States Patent
Primm et al.

(10) Patent No.: US 11,759,722 B2
(45) Date of Patent: Sep. 19, 2023

(54) SYSTEM AND METHOD FOR REPEATABLE SWITCHING BETWEEN AN ANIMATED FIGURE AND A FREE MOTION FIGURE

(71) Applicant: UNIVERSAL CITY STUDIOS LLC, Universal City, CA (US)

(72) Inventors: Kevin B. Primm, Orlando, FL (US); Robert R. Kipping, Orlando, FL (US); Jaemin Choi, Orlando, FL (US)

(73) Assignee: UNIVERSAL CITY STUDIOS LLC, Universal City, CA (US)

( * ) Notice: Subject to any disclaimer, the term of this patent is extended or adjusted under 35 U.S.C. 154(b) by 52 days.

(21) Appl. No.: 17/489,664

(22) Filed: Sep. 29, 2021

(65) Prior Publication Data

US 2022/0105442 A1 Apr. 7, 2022

Related U.S. Application Data

(60) Provisional application No. 63/087,133, filed on Oct. 2, 2020.

(51) Int. Cl.
*A63G 31/02* (2006.01)
*A63J 19/00* (2006.01)

(52) U.S. Cl.
CPC ..... *A63J 19/006* (2013.01); *A63G 31/02* (2013.01)

(58) Field of Classification Search
CPC ..... A63G 7/00; A63G 21/08; A63G 27/00; A63G 27/02; A63J 19/00
USPC ..... 472/59, 60, 77–80; 446/362
See application file for complete search history.

(56) References Cited

U.S. PATENT DOCUMENTS

| | | | |
|---|---|---|---|
| 8,286,907 | B2 | 10/2012 | Dohi et al. |
| 9,011,197 | B2 | 4/2015 | Smoot et al. |
| 10,688,401 | B1 | 6/2020 | Brister et al. |
| 2009/0298603 | A1 | 12/2009 | Crawford |
| 2010/0227527 | A1 | 9/2010 | Smoot et al. |
| 2015/0087431 | A1 | 3/2015 | Jackson |
| 2020/0223360 | A1 | 7/2020 | Bruno et al. |
| 2020/0265004 | A1* | 8/2020 | Brown ..... G06F 13/4072 |
| 2020/0289950 | A1 | 9/2020 | Krauthamer et al. |

OTHER PUBLICATIONS

International Search Report and Written Opinion, PCT/2021/052843, dated Jan. 14, 2022, 10 pgs.

* cited by examiner

*Primary Examiner* — Kien T Nguyen
(74) *Attorney, Agent, or Firm* — LOZA & LOZA, LLP; Lew Edward V. Macapagal

(57) ABSTRACT

A method of controlling a first figure configured to animate and a second figure configured to exhibit free motion in an amusement park ride includes determining when a field of view of a ride vehicle (RV) moving along a RV path of the ride is either directed away from a scene area of the ride or obstructed from the scene area, and responsive to such determination, causing a first mechanism associated with the first figure to move the first figure out of the scene area, and causing a second mechanism associated with the second figure to move the second figure into the scene area.

17 Claims, 20 Drawing Sheets

SYSTEM AND METHOD FOR REPEATABLE SWITCHING BETWEEN AN ANIMATED FIGURE AND A FREE MOTION FIGURE

CROSS-REFERENCE TO RELATED APPLICATION

This application claims priority to and the benefit of U.S. Provisional Application Ser. No. 63/087,133 entitled "SYSTEM AND METHOD FOR REPEATABLE SWITCHING BETWEEN AN ANIMATED FIGURE AND A FREE MOTION FIGURE" filed on Oct. 2, 2020, the entire contents of which is incorporated herein by reference as if fully set forth below in its entirety and for all applicable purposes.

TECHNICAL FIELD

The technology discussed below relates generally to amusement park ride systems, and more particularly, to systems and methods for repeatable switching between an animated figure and a free motion figure within a ride system.

INTRODUCTION

Amusement park rides may include animated figures that exhibit dynamic movement visible to riders as the riders progress through the ride attraction. Riders may see, for example, hand/arm movement and leg movement. Animated figures include animation mechanisms that enable these types of movements in response to control signals from an animation controller, and are typically attached to specific structures, e.g., platforms, walls, boxes, etc., at several attached points to secure them in place in a particular position. For example, different parts of a human animated figure may be secured to a platform to place the figure in a standing position, or to a seat to place the figure in a seated position.

In addition to animation, a ride attraction may include figures that exhibit free motion, such as a gravity free fall, a slip and fall, or a knock over. For example, as part of a ride attraction a figure standing at the edge of a platform may fall off the platform and drop to the ground.

In some ride attractions, it may be desirable for a figure to exhibit animated motions at certain times, and to exhibit free motion at other times. Unfortunately, because of their attachment points, animation mechanisms, interaction with an animation controller, and overall general structure, animated figures are not able to exhibit free motion in a manner convincing to riders. Furthermore, subjecting an animated figure to any significant or repeated G-forces puts severe stress on the animation mechanisms of these figures and limits their lifespan.

BRIEF SUMMARY OF SOME EXAMPLES

The following presents a summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

Aspects of the present disclosure are related to an amusement park system. The amusement park system includes a ride vehicle (RV). The RV has a field of view and configured to move along an RV path. The system also includes a first figure configured to animate within a scene area, and a first mechanism associated with the first figure, and is configured to move the first figure into and out of the scene area. The system further includes a second figure configured to exhibit free motion, and a second mechanism associated with the second figure, and configured to move the second figure into and out of the scene area, and a ride controller. The ride controller is configured to determine when the field of view of the RV is either directed away from the scene area or obstructed from the scene area, and responsive to such determination, to cause the first mechanism to move the first figure out of the scene area and the second mechanism to move the second figure into the scene area.

The present disclosure is also related to a method of controlling a first figure configured to animate and a second figure configured to exhibit free motion in an amusement park ride. The method includes determining when a field of view of a ride vehicle (RV) moving along a RV path of the ride is either directed away from a scene area of the ride or obstructed from the scene area, and responsive to such determination, causing a first mechanism associated with the first figure to move the first figure out of the scene area, and causing a second mechanism associated with the second figure to move the second figure into the scene area. The method may also include, subsequent to causing the second mechanism to move the second figure into the scene area, enabling the second figure to move to an outside location out of the scene area while exhibiting free motion. The method may further include, subsequent to enabling the second figure to move to an outside location out of the scene area, causing the first mechanism to move the first figure back into the scene area, and causing the second mechanism to move the second figure from the outside location to a location adjacent the scene area.

DETAILED DESCRIPTION

Figure 1:
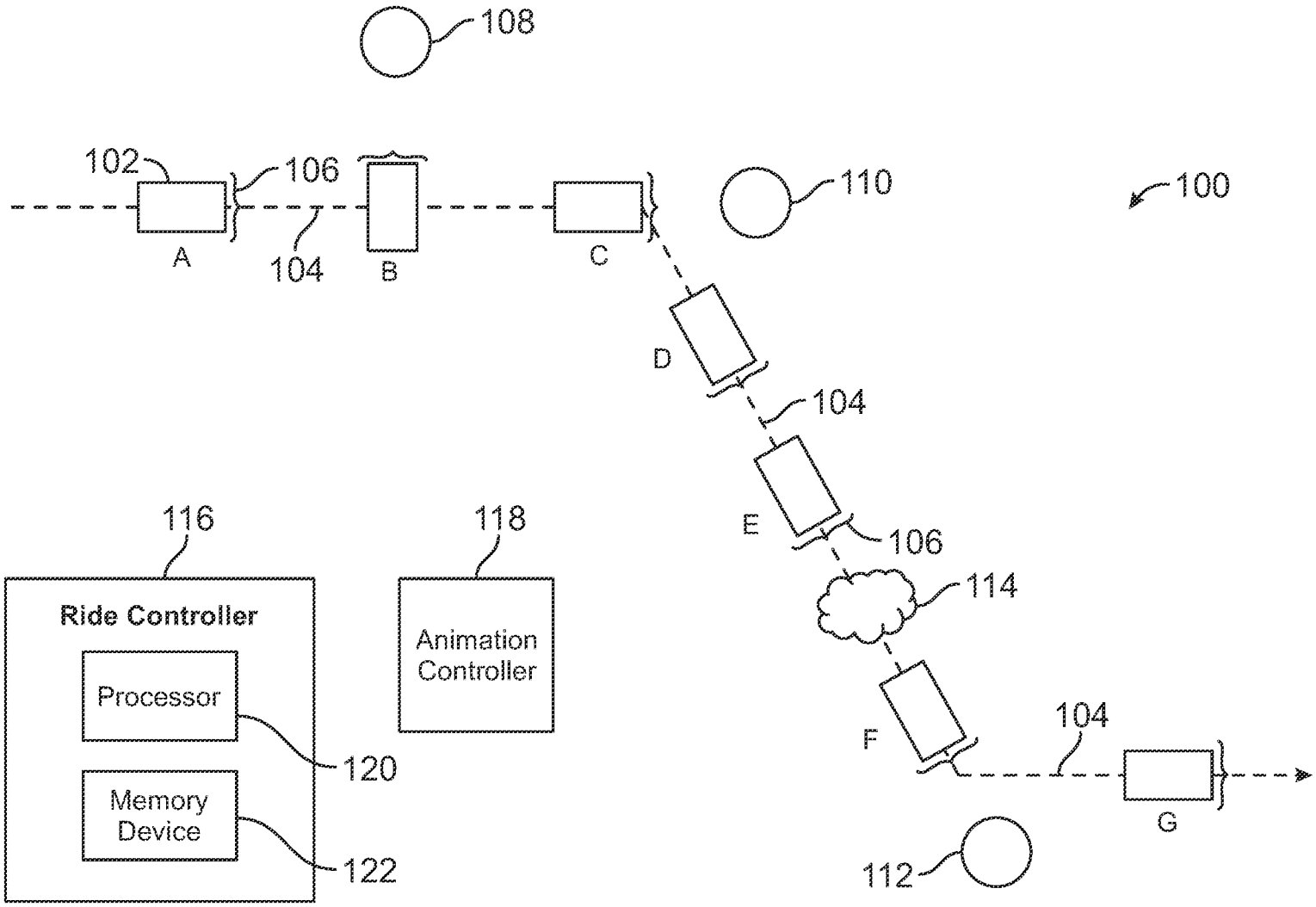
FIG. 1 is a schematic diagram of a portion of a ride system having one or more scene areas with repeatable switching between an animated figure and a free motion figure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts. While aspects and embodiments are described in this application by illustration to some examples, those skilled in the art will understand that additional implementations and use cases may come about in many different arrangements and scenarios. Innovations described herein may be implemented across many differing platform types, devices, systems, shapes, sizes, and/or packaging arrangements.

In an aspect, an amusement park system is provided that includes a ride vehicle (RV) configured to move through a ride attraction along an RV path. The ride vehicle has a field of view that allows riders to see thematic effects in one or more scene areas located at various points along the RV path. The system includes an animated figure and a free motion figure, each of which repeatedly switch in and out of a scene. The animated figure is configured to animate, e.g., perform dynamic moves including hand/arm movement and leg movement, under the control of an animation controller while it is within a scene area of the ride. The free motion figure is configured to exhibit free motion, e.g., fall easily at a near gravity speed while withstanding G-forces, as it moves out of the scene area. A first switching mechanism associated with the animated figure is configured to move the animated figure into and out of the scene area at appropriate times, while a second switching mechanism associated with the free motion figure is configured to move the free motion figure into and out of the scene area.

A ride controller determines when the field of view of the RV is either directed away from the scene area or obstructed from the scene area such that the riders are distracted. In response to such determination, the ride controller causes the first mechanism to move the animated figure out of the scene area and the second mechanism to move the free motion figure into the scene area. After the free motion figure is in the scene area, the ride controller enables the free motion figure to move to an outside location out of the scene area in a free motion manner. For example, the free motion figure may fall out of the scene area at a high rate of speed. After the free motion figure has moved out of the scene area, the ride controller causes the first mechanism and the second mechanism to reset the scene area for the next ride vehicle by moving the animated figure back into the scene area and placing the free motion figure at a location near the scene area.

Having generally described a ride system having repeatable switching between an animated figure and a free motion figure, a more detailed description of the systems and its mechanisms follows, beginning with reference to FIG. 1.

FIG. 1 is a schematic illustration of a portion of a ride system 100 of an amusement park. The ride system 100 includes a ride vehicle 102 configured to move along a ride vehicle (RV) path 104 of the ride system. While multiple ride vehicles 102 may move along the RV path 104 at any given time, for clarity of illustration and description, a single ride vehicle 102 is shown in FIG. 1 at various points (A through G) along a portion of the RV path 104. The RV path 104 may be defined by a track that guides a ride vehicle 102 through one or both of ground portions and aerial portions of a ride. Each ride vehicle 102 is characterized by a field of view 106 that enable riders within a vehicle to view various thematic effects, such as animated figures, special effects, as the vehicle 102 travels along the RV path 104. A field of view 106 of a ride vehicle 102 may be an opening or a window at the front, side, and/or back of a vehicle that provides visibility to the riders.

Figure 2:
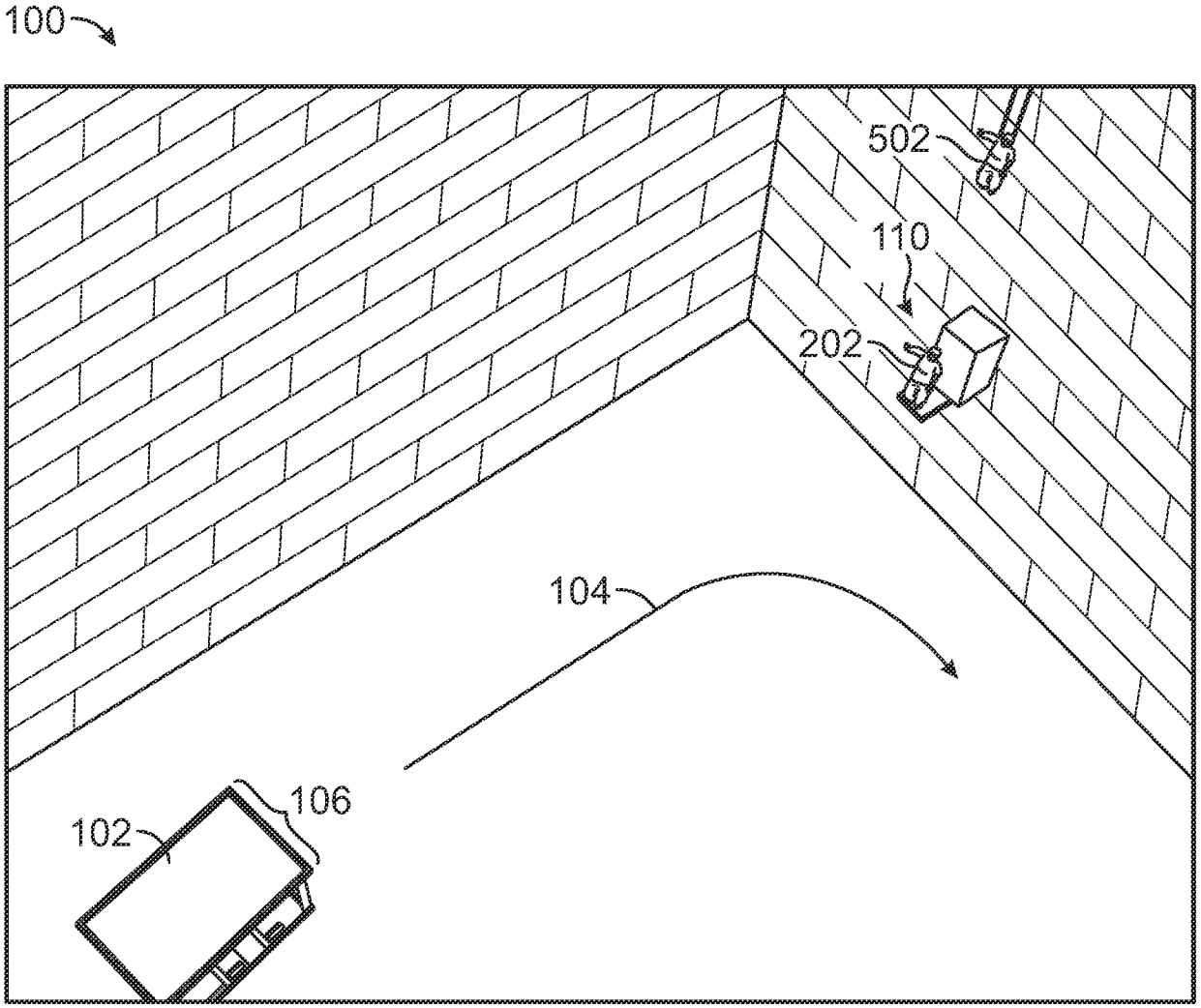
FIG. 2 is an illustration of a portion of a ride system with a scene area with repeatable switching between an animated figure and a free motion figure.
Figure 3:
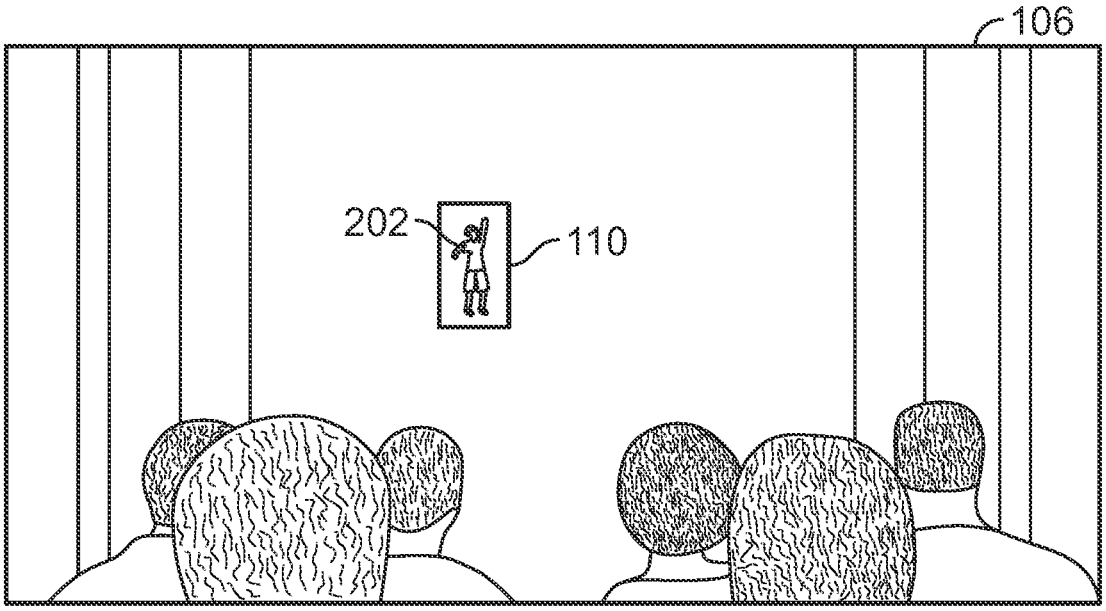
FIG. 3 is an illustration of parts of a ride system that are visible from a field of view of a ride vehicle while the field of view is directed toward a first scene area and an animated figure is in the scene area.

The ride system 100 may include one or more scene areas 108, 110, 112 along the path 104 in which thematic effects involving one or more figures may occur. For example, a ride vehicle 102 at point A along the RV path 104 has its field of view 106 in the direction of scene area 110. With reference to FIGS. 2 and 3, at this point a first figure 202 in the scene area 110 is in the field of view 106. The first figure 202 may be configured to animate under the control of an animation controller 118 during the time that the scene area 110 is in the field of view 106 of the ride vehicle 102. A scene area 108, 110, 112 is a physical space within the ride attraction that may at times have one or more thematic figures present therein, and at other times may be empty. While a single animation controller 118 is shown in FIG. 1 way from the scene areas 108, 110, 112, the ride system 100 may include multiple animation controllers, each associated with an animated figure in a scene area.

Figure 4:
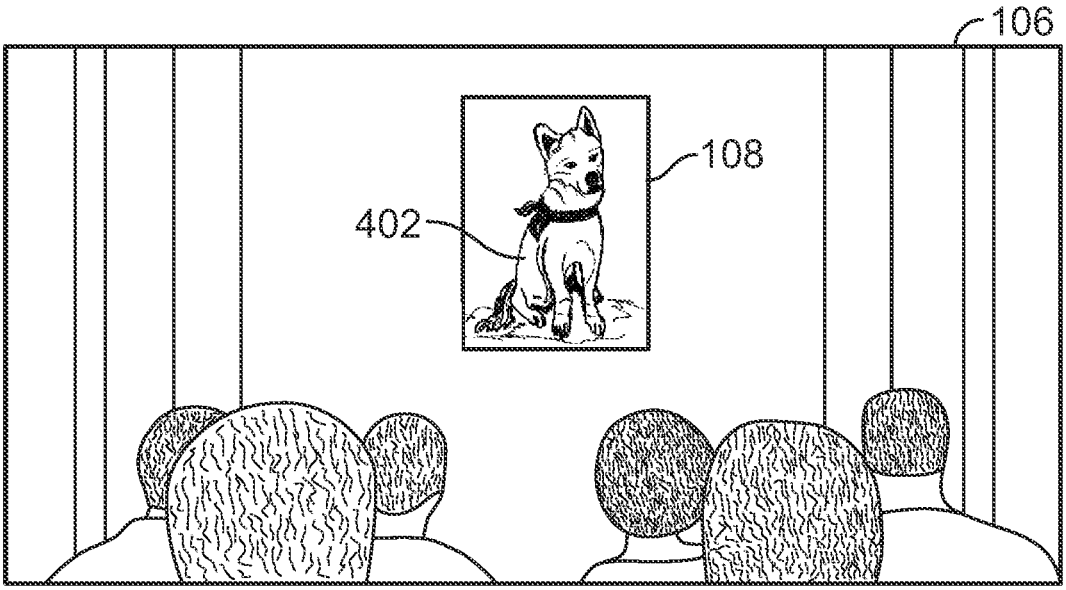
FIG. 4 is an illustration of parts of a ride system that are visible from a field of view of a ride vehicle while the field of view is directed toward a second scene area.
Figures 5A, 5B:
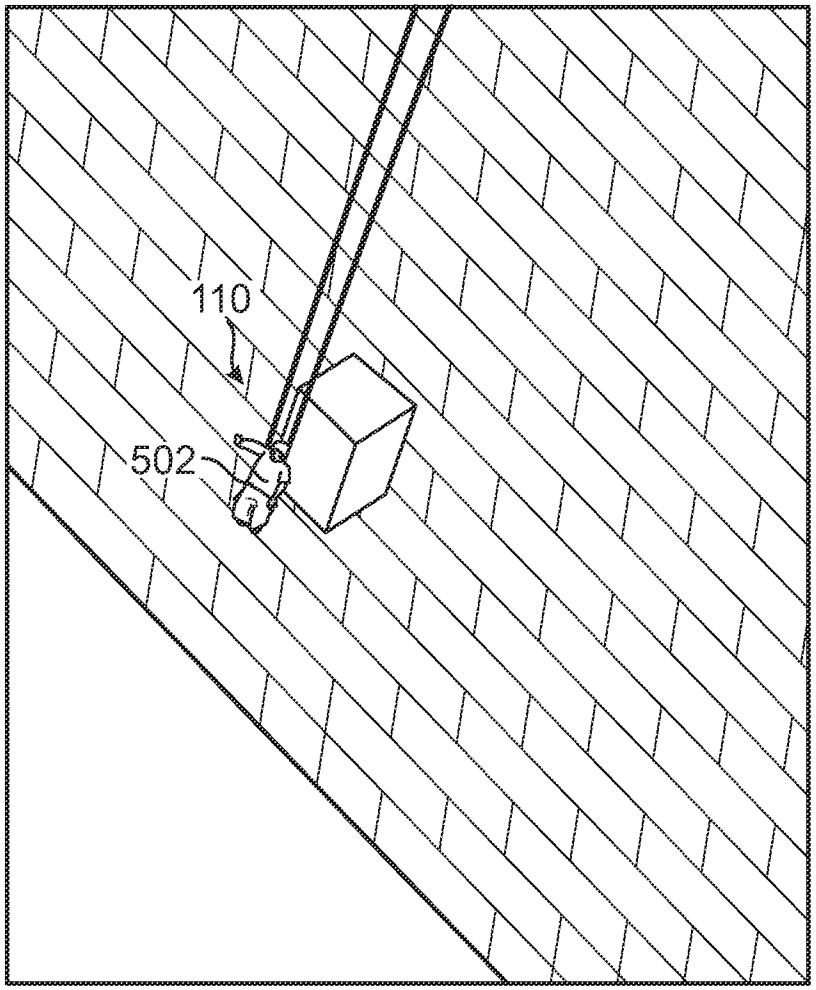
FIGS. 5A and 5B are illustrations of a switching between an animated figure and a free motion figure in a scene area.

Returning to FIG. 1, at point B along the RV path 104 the ride vehicle 102 is rotated such that the field of view 106 is now in the direction of scene area 108. With reference to FIG. 4, at this point a figure 402 in the scene area 108 is in the field of view 106. While the field of view 106 of the ride vehicle 102 is directed toward the scene area 108, a switching of figures occurs in the scene area 110. More specifically, with reference to FIGS. 5A and 5B, the first figure 202 in scene area 110 is replaced with a second figure 502. The second figure 502 has the same appearance as the first figure 202, but is configured to exhibit free motion. Exhibiting free motion means that the second figure 502 moves in a manner perceived by a viewer as smooth, life-like motion, as opposed to robotic jerking or halted motion associated with aminated figures. For example, the second figure 502 may appear to fall from the sky under the force of gravity.

Mechanisms for enabling the replacement or switching of the first figure 202 and the second figure 502 are described below.

Figure 6:
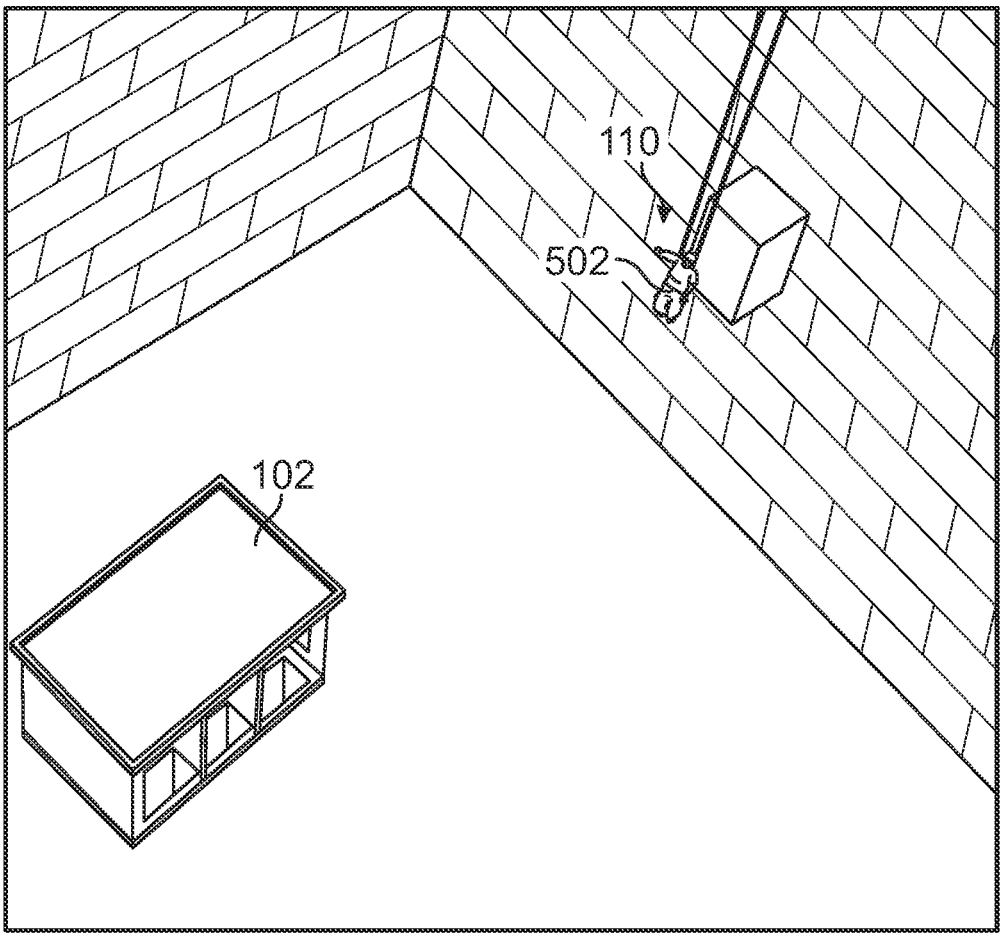
FIG. 6 is an illustration of the portion of a ride system of FIG. 2 after the animated figure has been replace by a free motion figure.
Figure 7:
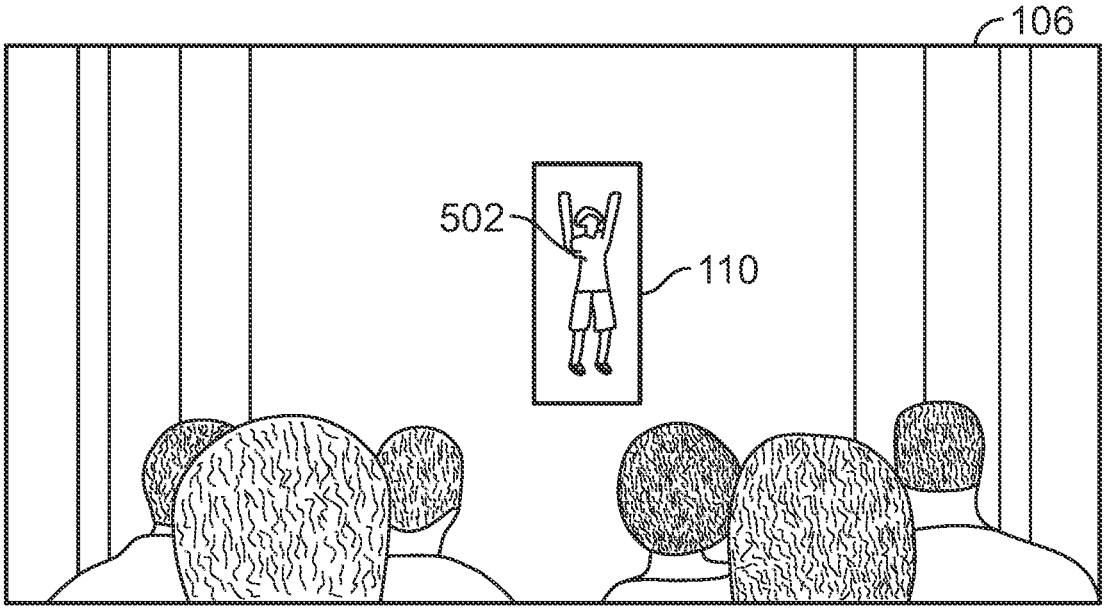
FIG. 7 is an illustration of parts of a ride system that are visible from a field of view of a ride vehicle while the field of view is directed toward the first scene area and a free motion figure is in the scene area.
Figure 9:
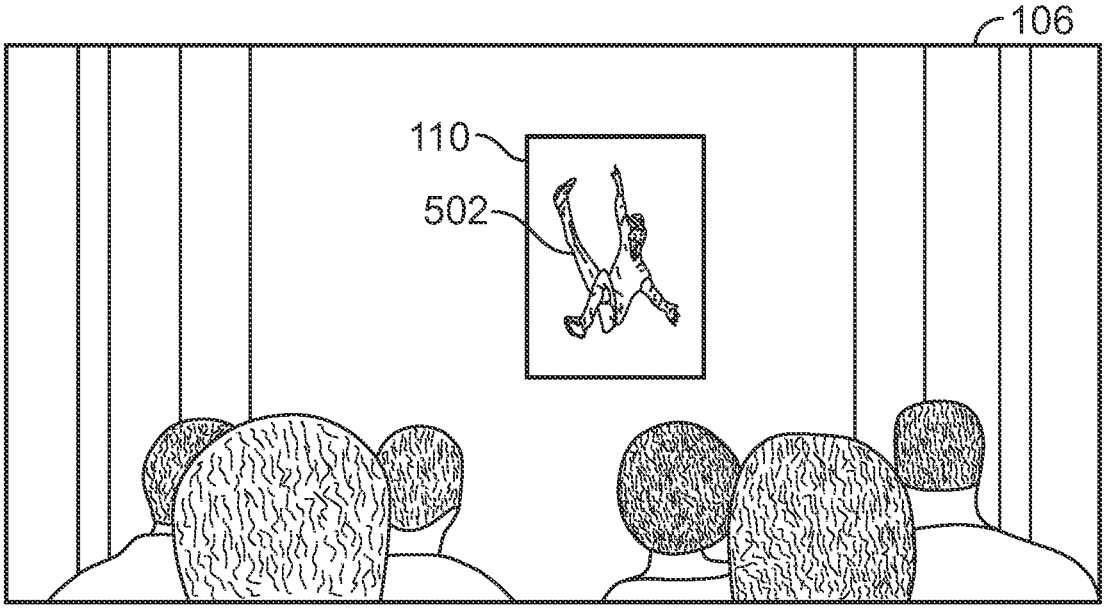
FIG. 9 is an illustration of parts of a ride system that are visible from a field of view of a ride vehicle while the field of view is directed toward the first scene area and the free motion figure of FIG. 7 is free falling out of the scene area.
Figure 8:
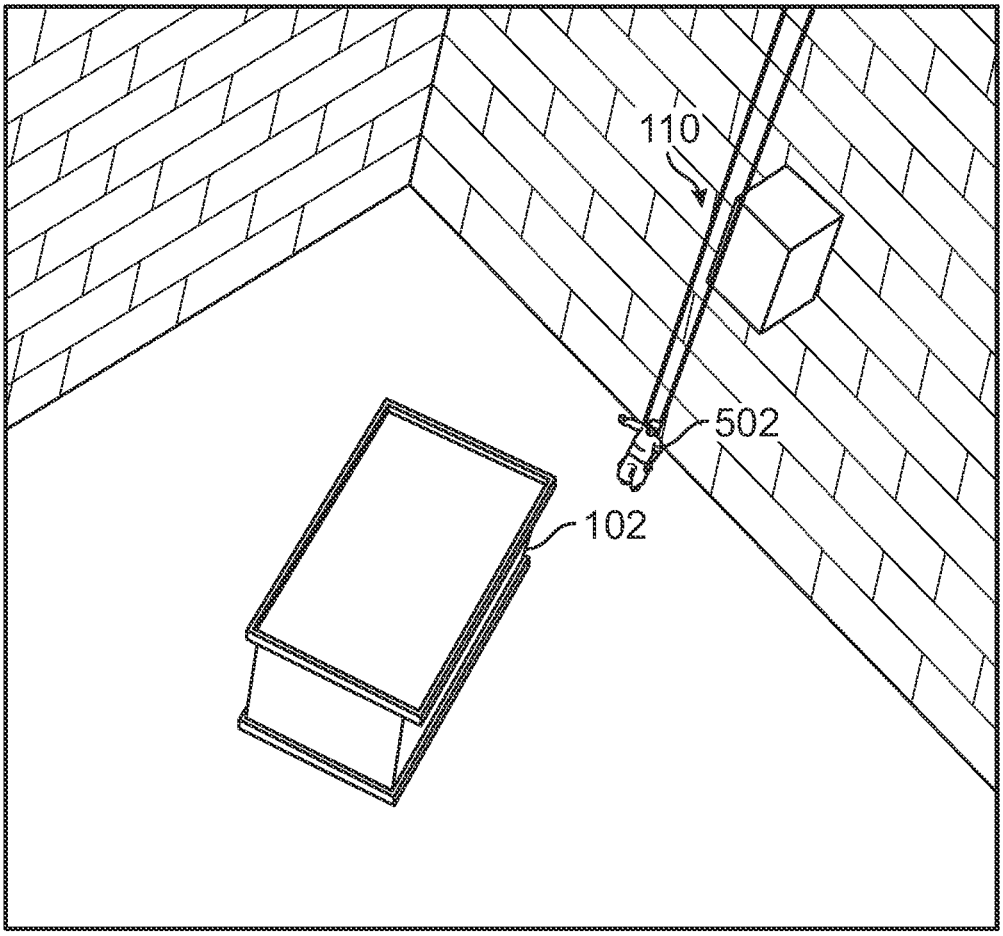
FIG. 8 is an illustration of the portion of a ride system of FIG. 6 after the free motion figure has dropped from the scene area.

Returning to FIG. 1, and with additional reference to FIG. 6, at point C along the RV path 104 the ride vehicle 102 is rotated such that the field of view 106 is once again in the direction of scene area 110. With reference to FIG. 7, at this point the second figure 502 in the scene area 110 is in the field of view 106. With reference to FIGS. 8 and 9, while the ride vehicle 102 is still in the area of point C, the second figure 502 exhibits a free motion. For example, the second figure 502 may appear to drop or free fall from the scene area 110. Mechanisms for enabling this kind of movement of the second figure 502 are described below.

Returning to FIG. 1, at point D along the RV path 104 the ride vehicle 102 is rotated such that the field of view 106 is directed away from the scene area 110 and in the direction of scene area 112. Once the field of view 106 is directed away from the scene area 110 the first figure 202 is placed back in the scene area 110 and the second figure 502 is returned to its original location that allows for it to be switched again for the next ride vehicle. Mechanisms for enabling the replacement or switching of the first figure 202 and the second figure 502 are described below.

Continuing with FIG. 1, at point E along the RV path 104 the field of view 106 of the ride vehicle 102 may be obstructed by a visual event 114. For example, the ride vehicle 102 may pass by an object that blocks the field of view 106, or a flash of bright light or a puff of dense smoke may occur within the field of view. During this time, a switching of figures may occur in the scene area 112, like that described above for scene area 110.

At point F along the RV path 104, the ride vehicle 102 has passed through the visual event 114 and the field of view 106 to the scene area 112 is once again unimpeded. At this time, the figure in the scene area 112 may exhibit a free motion. For example, like the second figure 502 in the scene area 110, the figure may appear to drop or free fall vertically from the scene area 112. Alternatively, the figure may move laterally to the side and out of the scene area, or float vertically upward, out of the scene area 112, or may be hit by an object in the scene area and thereby smacked laterally into a wall in the scene area or hit off a ledge in the scene area. In one configuration, the free motion of the second figure 502 may be initiated by the ride vehicle itself. For example, a front corner of the ride vehicle 102 may hit the second figure 502 as the ride vehicle turns away from the scene area.

At point G along the RV path 104 the ride vehicle 102 is rotated such that the field of view 106 is directed away from the scene area 112. Once the field of view 106 is directed away from the scene area 112 the figures associated with the scene area may be returned to their original locations to await the next ride vehicle.

Having thus described the operation of the ride system 100, descriptions of several mechanisms for enabling the switching of figures follows.

FIGS. 10A-10D illustrate a first embodiment of mechanisms for repeatable switching between an animated figure 202 and a free motion figure 502 relative to a scene area of a ride system. A first mechanism 1002 associated with the animated figure 202 is configured to move the animated figure into and out of the scene area. Movement out of the scene area with respect to an animated figure 202 means that the animated figure is physically moved to a location where its visibility from the field of view of the ride vehicle may be completely eliminated or at least significantly reduced. Conversely, movement into the scene area with respect to an animated figure 202 means that the animated figure is physically moved to a location where it is visible from the field of view of the ride vehicle. Animated figures 202 are typically not far removed from the scene area due to their heavyweight structure and their association within an animation controller 118 which may require wired connections.

A second mechanism 1004 associated with the free motion figure 502 is configured to move the free motion figure into and out of the scene area. Movement into the scene area with respect to a free motion figure 502 means that the animated figure is physically moved to a location where it is visible from the field of view of the ride vehicle. Conversely, movement out of the scene area with respect to a free motion figure 502 means that the free motion figure is physically moved to a location where its visibility from the field of view of the ride vehicle may be completely eliminated or at least significantly reduced. Free motion figures 502 are typically further removed from the scene area relative to animated figures due to their lightweight structure and their association with thematic effects that require such removal, including for example free falling completely out of the scene area.

The first mechanism 1002 includes a base structure 1006 configured to support the animated figure 202. For example, a portion 1008, e.g., feet, of the animated figure 202 may be secured to the base structure 1006. The base structure 1006 is configured to slide between a first position (as shown in FIG. 10A) that places the animated figure 202 in the scene area, and a second position (as shown in FIGS. 10B-10D) that places the animated figure 202 out of the scene area.

The first mechanism 1002 includes a structure 1010 configured to impede visibility of the animated figure 202 while the figure is out of the scene area. The structure 1010 may be a box into which the animated figure is slid.

Figure 10A:
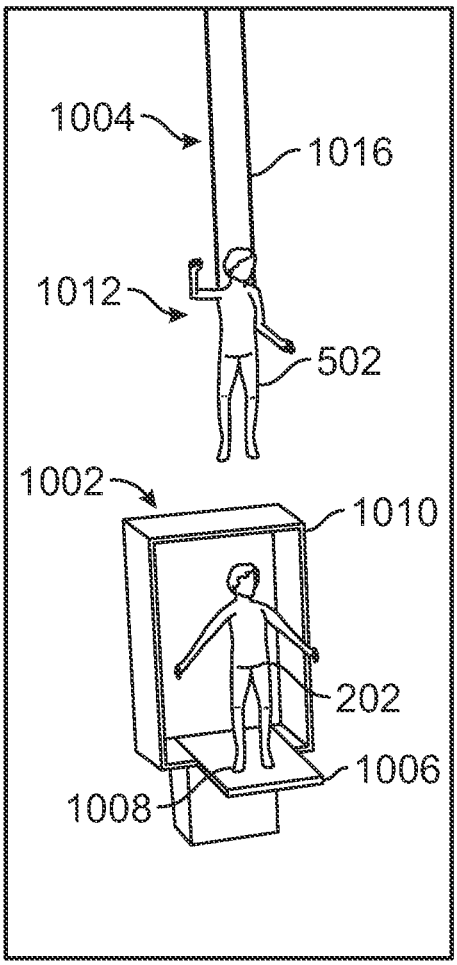
FIGS. 10A-10D illustrate a first embodiment of mechanisms for repeatable switching between an animated figure and a free motion figure.
Figure 10B:
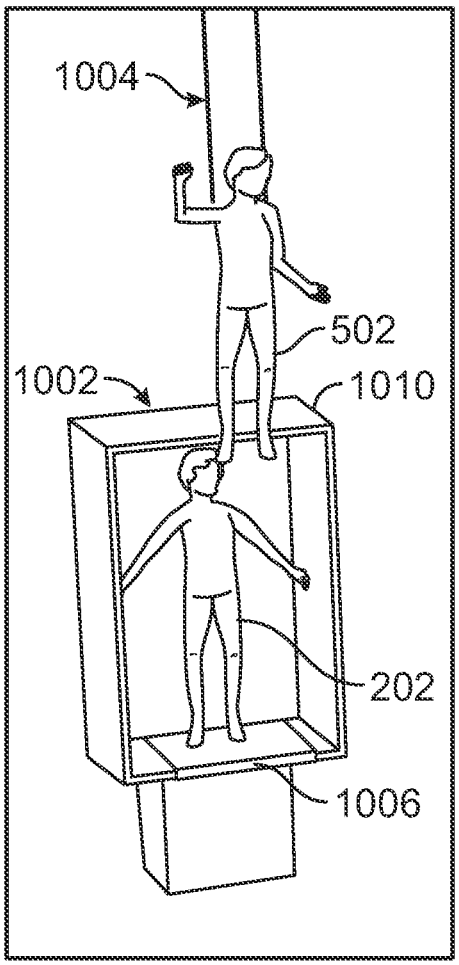
Figure 10C:
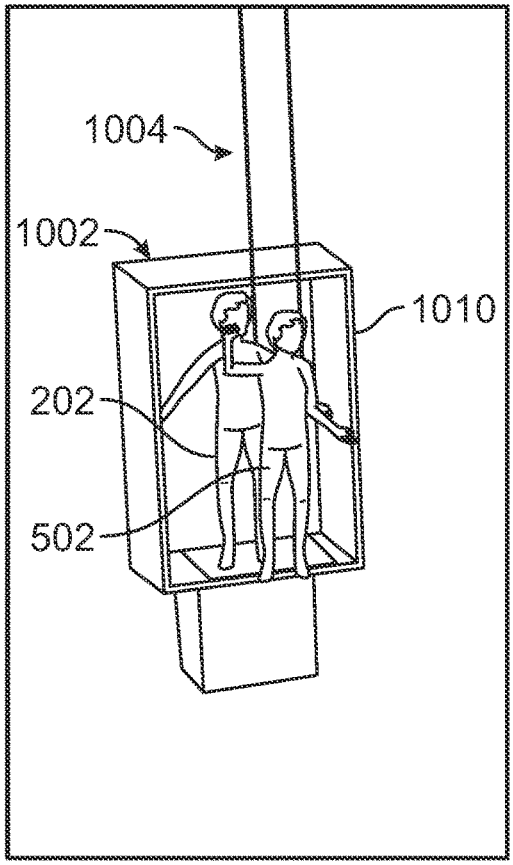
Figure 10D:
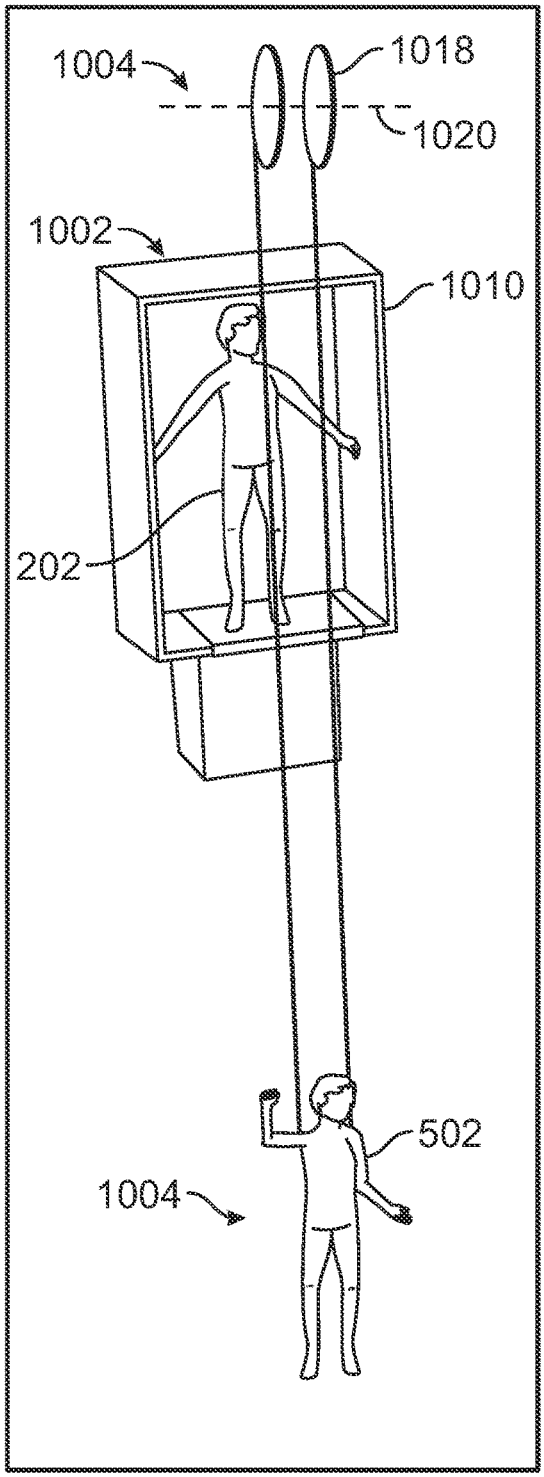

The second mechanism 1004 is configured to suspend the free motion figure 502 at a first location 1012 adjacent the scene area, e.g., above and out of the scene area (as shown in FIG. 10A). The second mechanism 1004 is also configured to move the free-motion figure into the scene area (as shown in FIGS. 10B and 10C). The second mechanism 1004 is further configured to allow the free motion figure 502 to move, in a free motion manner, to an outside location 1014 out of the scene area (as shown in FIG. 10D).

In one configuration, the second mechanism 1004 includes a pair of suspension cables 1016 attached at one end to the free motion figure 502 and the other end to a wheel assembly 1018. The wheel assembly 1018, at the appropriate time and under the control of a ride controller 116, rotates about an axis 1020 to lower the free motion figure 502 into the scene area (as shown in FIGS. 10B and 10C). At the appropriate time, the wheel assembly 1018, again under the control of the ride controller 116, releases itself to spin freely or near-freely, which in turn enables the free motion figure 502 to initiate a vertical free fall of the figure (as shown in FIG. 10D). Later, at the appropriate time during the ride and under the control of the ride controller 116, the wheel assembly 1018 lifts the free motion figure 502 from the outside location 1014 back to the first location 1012. To do this without having the free motion figure 502 pass through the scene area, the wheel assembly 1018 may be configured to slide along the axis 1020 to thereby move the free motion figure 502 to a location that allows for the lifting of the figure along a path outside the scene area.

FIGS. 11A-11D illustrate a second embodiment of mechanisms for repeatable switching between an animated figure 202 and a free motion figure 502 relative to a scene area of a ride system. A first mechanism 1102 associated with the animated figure 202 is configured to move the animated figure into and out of the scene area. Like the first embodiment, movement out of the scene area with respect to an animated figure 202 means that the animated figure is physically moved to a location where its visibility from the field of view of the ride vehicle may be completely eliminated or at least significantly reduced. Conversely, movement into the scene area with respect to an animated figure 202 means that the animated figure is physically moved to a location where it is visible from the field of view of the ride vehicle.

A second mechanism 1104 associated with the free motion figure 502 is configured to move the free motion figure into and out of the scene area. Like the first embodiment, movement into the scene area with respect to a free motion figure 502 means that the animated figure is physically moved to a location where it is visible from the field of view of the ride vehicle. Conversely, movement out of the scene area with respect to a free motion figure 502 means that the free motion figure is physically moved to a location where its visibility from the field of view of the ride vehicle may be completely eliminated or at least significantly reduced.

Figure 11A:
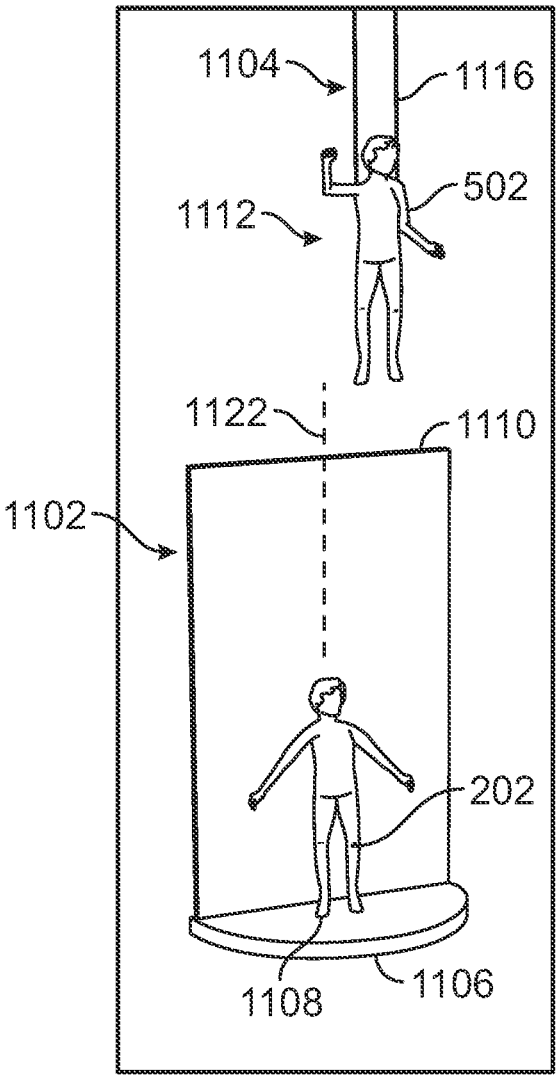
FIGS. 11A-11D illustrate a second embodiment of mechanisms for repeatable switching between an animated figure and a free motion figure.
Figure 11B:
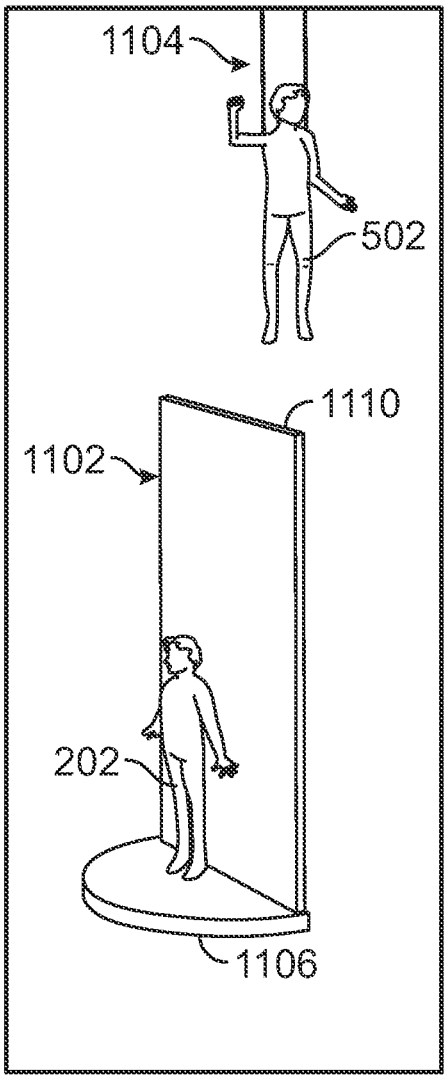
Figure 11C:
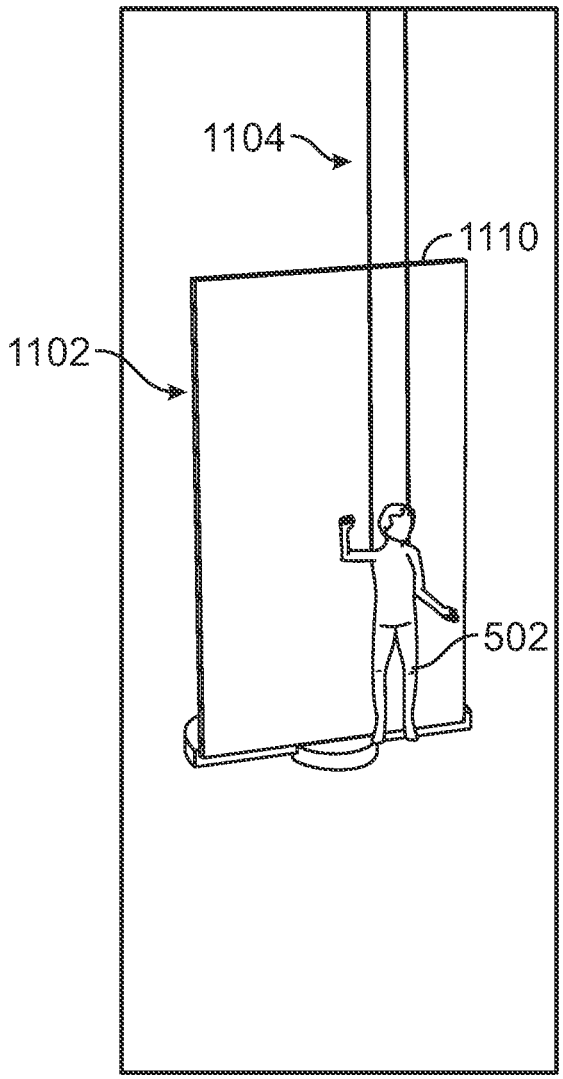
Figure 11D:
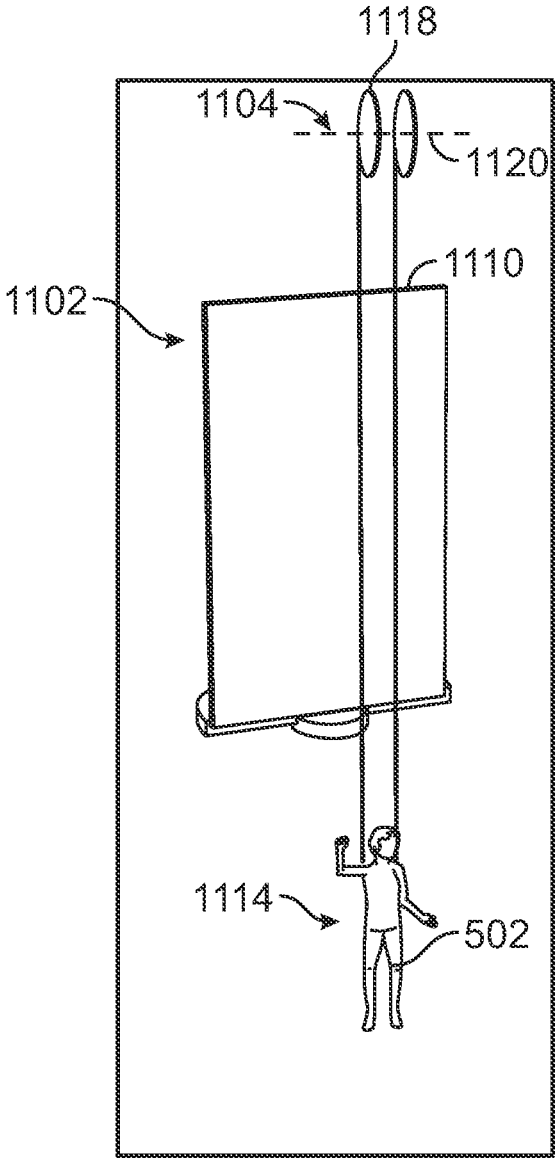

The first mechanism 1102 includes a base structure 1106 configured to support the animated figure 202. For example, a portion 1108, e.g., feet, of the animated figure 202, may be secured to the base structure 1106. The base structure 1106 is configured to rotate about an axis 1122 between a first position (as shown in FIG. 11A) that places the animated figure 202 in the scene area, and a second position (as shown in FIGS. 11C and 11D) that places the animated figure 202 out of the scene area.

The first mechanism 1102 includes a structure 1110 configured to impede visibility of the animated figure 202 while the figure is out of the scene area. The structure 1110 may be a wall behind which the animated figure is placed relative to the field of view of the ride vehicle.

The second mechanism 1104 is configured to suspend the free motion figure 502 at a first location 1112 above and out of the scene area (as shown in FIG. 10A). The second mechanism 1104 is also configured to move the free-motion figure into the scene area (as shown in FIG. 11C). The second mechanism 1104 is further configured to allow the free motion figure 502 to move, in a free motion manner, to an outside location 1114 out of the scene area (as shown in FIG. 10D).

In one configuration, the second mechanism 1104 includes a pair of suspension cables 1116 attached at one end to the free motion figure 502 and the other end to a wheel assembly 1118. The wheel assembly 1118, at the appropriate time and under the control of the ride controller 116, rotates about an axis 1120 to lower the free motion figure 502 into the scene area (as shown in FIG. 11C). At the appropriate time, the wheel assembly 1118, again under the control of the ride controller 116, releases itself to spin freely or near-freely, which in turn enables the free motion figure 502 to initiate a vertical free fall of the figure (as shown in FIG. 11D). Later, at the appropriate time during the ride and under the control of the ride controller 116, the wheel assembly 1118 rotates about the axis 1120 to lift the free motion figure 502 from the outside location 1114 back to the first location 1112. To do this without having the free motion figure 502 pass through the scene area, the wheel assembly 1118 may be configured to slide along the axis 1020 to thereby move the free motion figure 502 to a location that allows for the lifting of the figure along a path that does not pass through the scene area.

FIGS. 12A-12E illustrate a third embodiment of mechanisms for repeatable switching between an animated figure 202 and a free motion figure 502 relative to a scene area of a ride system. A first mechanism 1202 associated with the animated figure 202 is configured to move the animated figure into and out of the scene area. Like the first and second embodiments, movement out of the scene area with respect to an animated figure 202 means that the animated figure is physically moved to a location where its visibility from the field of view of the ride vehicle may be completely eliminated or at least significantly reduced. Conversely, movement into the scene area with respect to an animated figure 202 means that the animated figure is physically moved to a location where it is visible from the field of view of the ride vehicle.

A second mechanism 1204 associated with the free motion figure 502 is configured to move the free motion figure into and out of the scene area. Like the first and second embodiment, movement into the scene area with respect to a free motion figure 502 means that the animated figure is physically moved to a location where it is visible from the field of view of the ride vehicle. Conversely, movement out of the scene area with respect to a free motion figure 502 means that the free motion figure is physically moved to a location where its visibility from the field of view of the ride vehicle may be completely eliminated or at least significantly reduced.

Figure 12A:
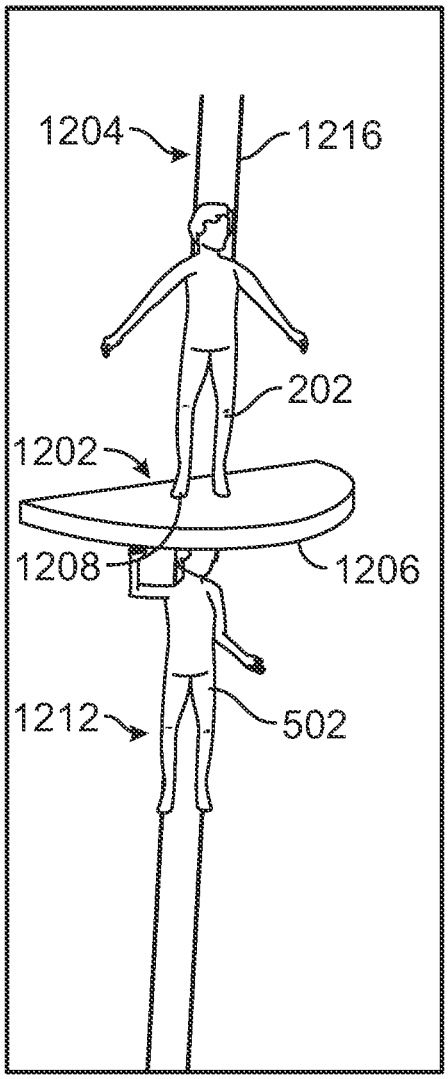
FIGS. 12A-12E illustrate a third embodiment of mechanisms for repeatable switching between an animated figure and a free motion figure.
Figure 12B:
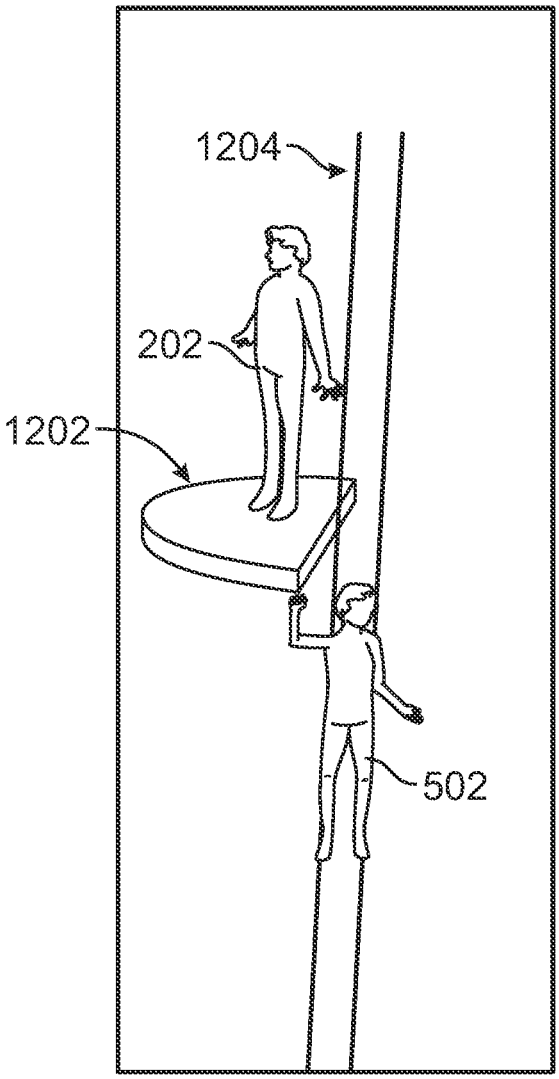
Figure 12C:
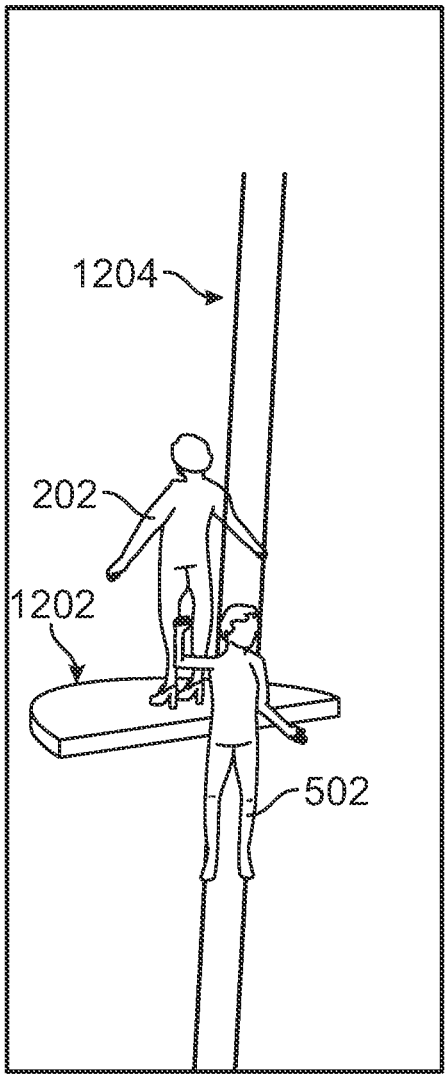
Figure 12D:
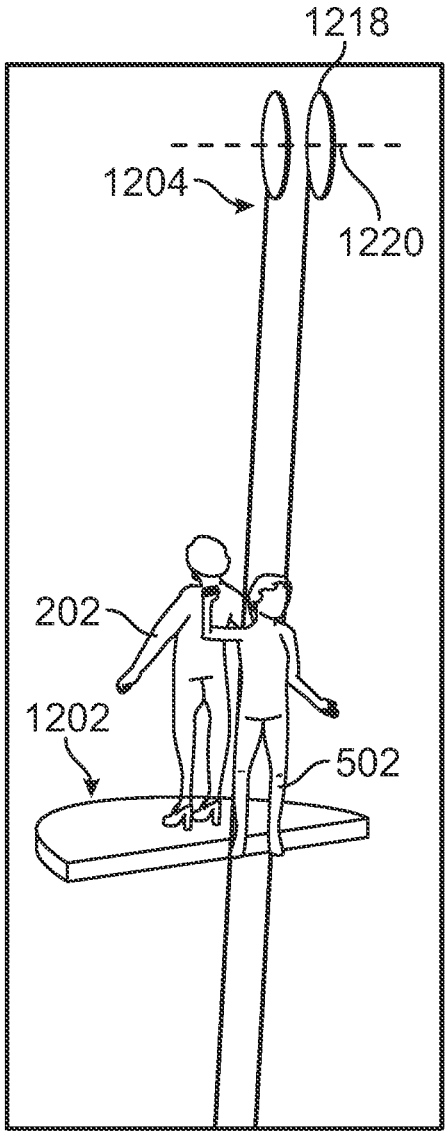
Figure 12E:
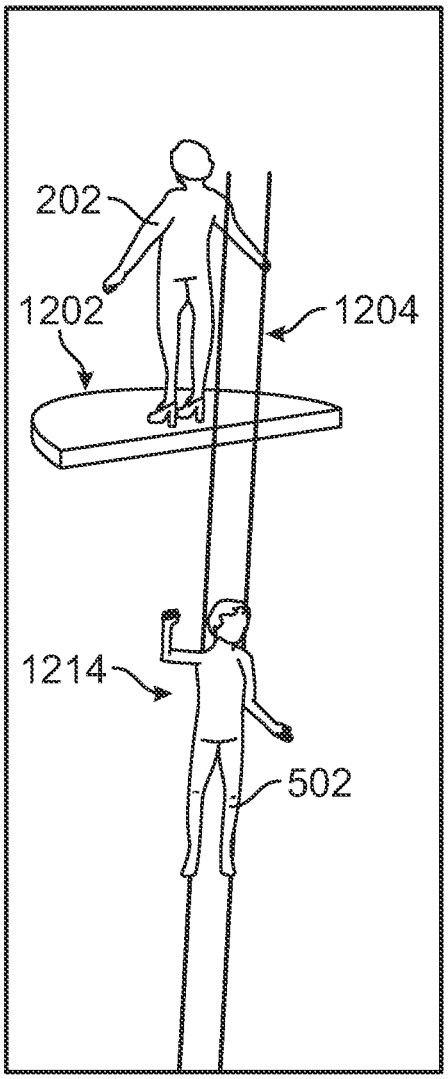

The first mechanism 1202 includes a semicircular base structure 1206 configured to support the animated figure 202. For example, a portion 1208, e.g., feet, of the animated figure 202 may be secured to the base structure 1206. The base structure 1206 is configured to rotate about an axis between a first position (as shown in FIG. 12A) that places the animated figure 202 in the scene area, and a second position (as shown in FIGS. 12C-12E) that places the animated figure 202 out of the scene area.

While the first mechanism 1202 of this embodiment does not include a physical structure, e.g., wall or box, configured to impede visibility of the animated figure 202 while the figure is out of the scene area, visibility of the animated figure may be impeded by the free motion figure 502. For example, with reference to FIG. 12D, the free motion figure 502 may be moved to a location that blocks the animated figure from the field of view of a ride vehicle, The second mechanism 1204 is configured to suspend the free motion figure 502 at a first location 1212 beneath and out of the scene area (as shown in FIG. 12A). The second mechanism 1204 is also configured to move the free-motion figure into the scene area (as shown in FIGS. 12C and 12D). The second mechanism 1204 is further configured to allow the free motion figure 502 to move, in a free motion manner, to an outside location 1214 beneath and out of the scene area (as shown in FIG. 12E).

In one configuration, the second mechanism 1204 includes a pair of suspension cables 1216 attached at one end to the free motion figure 502 and the other end to a wheel assembly 1218. The wheel assembly 1218, at the appropriate time and under the control of the ride controller 116, rotates about an axis 1220 to raise the free motion figure 502 into the scene area (as shown in FIGS. 12C and 12D). At the appropriate time, the wheel assembly 1218, again under the control of the ride controller 116, releases itself to freely or near-freely spin, which in turn enables the free motion figure 502 to initiate a vertical free fall of the figure to the outside location 1214 (as shown in FIG. 12E). Later, at the appropriate time during the ride and under the control of the ride controller 116, the wheel assembly 1218 rotates about the axis 1120 to lift the free motion figure 502 from the outside location 1214 back to the first location 1212 (shown in FIG. 12A). In this embodiment, movement of the free motion figure 502 after the free fall is entirely beneath the scene area so the free motion figure 502 does not enter the scene area while being returned to the first location 1212, as is done in the first and second embodiments.

FIGS. 13A-13F illustrate a fourth embodiment of mechanisms for repeatable switching between an animated figure 202 and a free motion figure 502 relative to a scene area of a ride system. A first mechanism 1302 associated with the animated figure 202 is configured to move the animated figure into and out of the scene area. Like the first embodiment, movement out of the scene area with respect to an animated figure 202 means that the animated figure is physically moved to a location where its visibility from the field of view of the ride vehicle may be completely eliminated or at least significantly reduced. Conversely, movement into the scene area with respect to an animated figure 202 means that the animated figure is physically moved to a location where it is visible from the field of view of the ride vehicle.

A second mechanism 1304 associated with the free motion figure 502 is configured to move the free motion figure into and out of the scene area. Like the first embodiment, movement into the scene area with respect to a free motion figure 502 means that the animated figure is physically moved to a location where it is visible from the field of view of the ride vehicle. Conversely, movement out of the scene area with respect to a free motion figure 502 means that the free motion figure is physically moved to a location where its visibility from the field of view of the ride vehicle may be completely eliminated.

The first mechanism 1302 includes a base structure 1306 having a first portion 1316 configured to support the animated figure 202. For example, a portion 1308, e.g., feet, of the animated figure 202 may be secured to the first portion 1316. The base structure 1306 also has a second portion 1318 configured to support the free motion figure 502. Support of the free motion figure 502 by the second portion 1318 may include a portion 1320, e.g., feet, of the free motion figure resting on the top surface of the second portion, without being secured thereto.

The first mechanism 1302 also includes a structure 1310 configured to impede visibility of the animated figure 202 while the figure is out of the scene area, and to impede visibility of the free motion figure 502 while the figure is out of the scene area. The structure 1310 may be a wall behind which either of the animated figure 202 or the free motion figure 502 is placed relative to the field of view of the ride vehicle.

Continuing with the first mechanism 1302, the second portion 1318 and the first portion 1316 of the base structure 1306 are configured such that the second portion may transition between a first position where it lies in a common plane with the first portion, and a second position where it lies is a plane different from the first portion. For example, with reference to FIG. 13C, the first portion 1316 and the second portion 1318 may lie in a common horizontal plane. While, with reference to FIG. 13F, the second portion 1318 may transition to lie in a vertical plane relative to the first portion 1316. To enable such transitioning of the second portion 1318, the second portion may be hinged to either one of the first portion 1316 or the wall 1310.

Figure 13A:
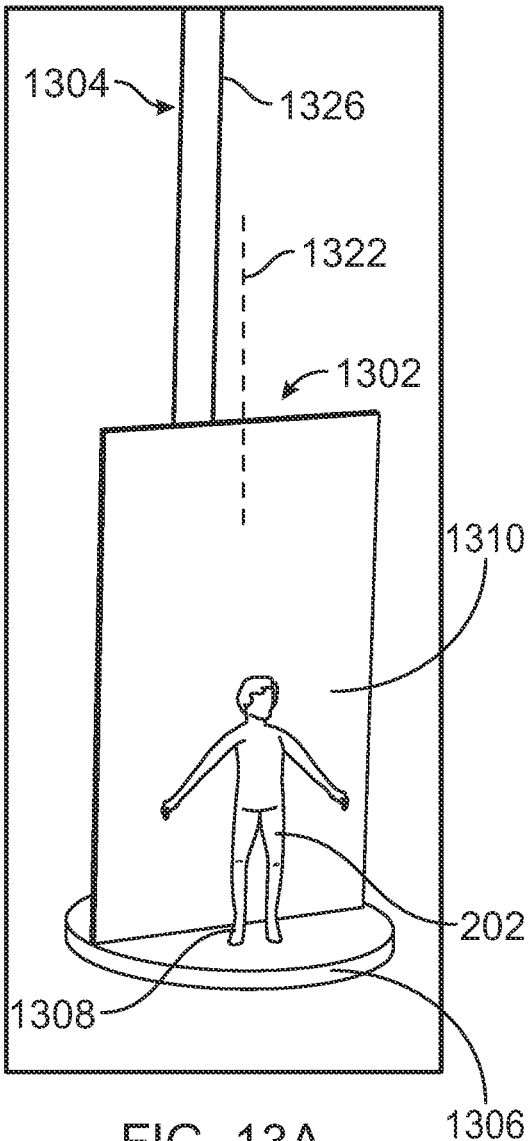
FIGS. 13A-13F illustrate a fourth embodiment of mechanisms for repeatable switching between an animated figure and a free motion figure.
Figure 13B:
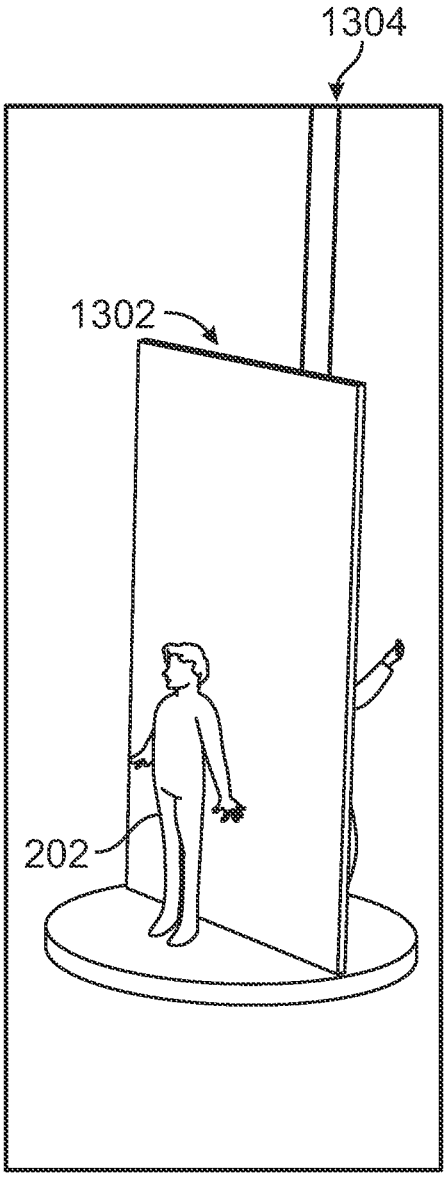
Figure 13C:
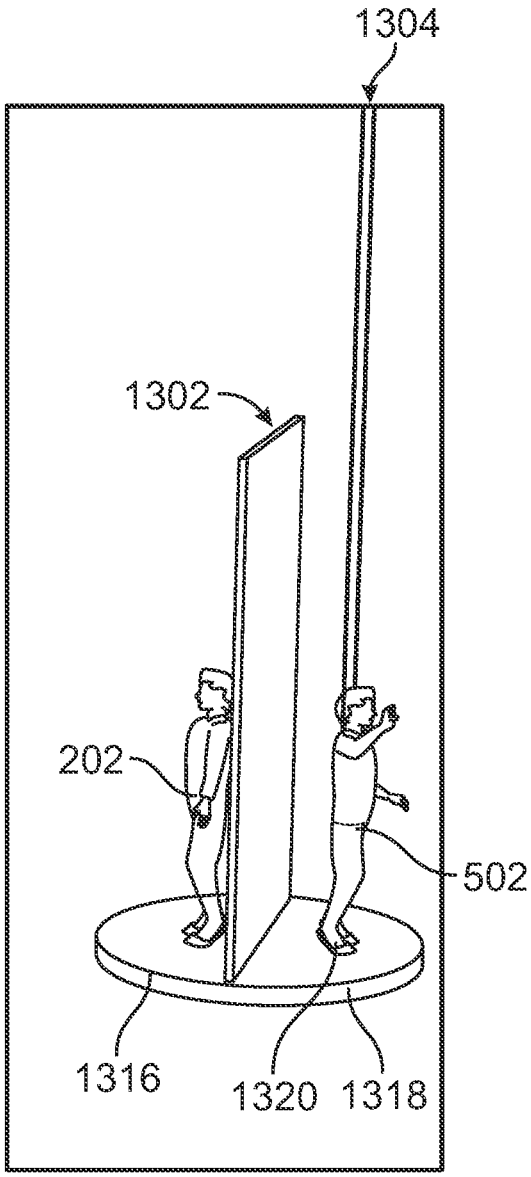
Figure 13D:
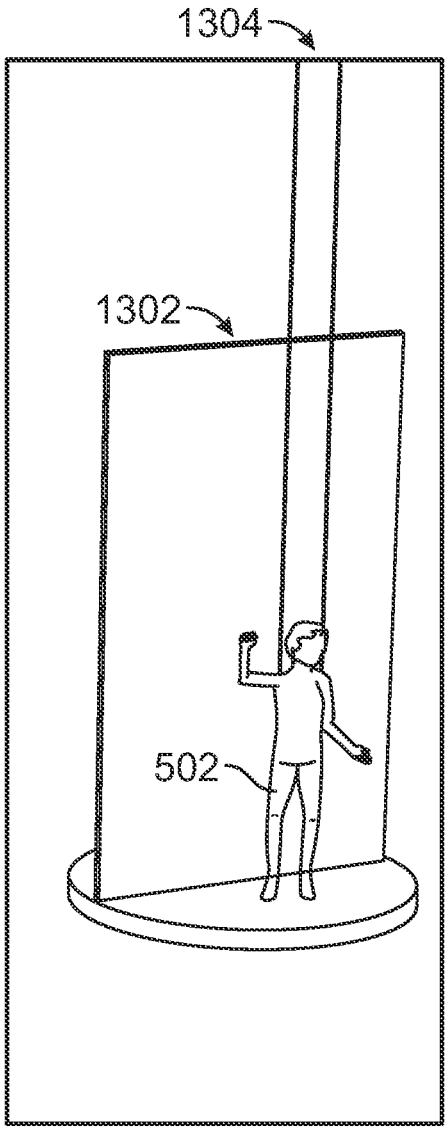

The first mechanism 1302, e.g., the base structure 1306 and the structure 1310, is configured to rotate about an axis 1322 between a first position (as shown in FIG. 13A) that places the animated figure 202 in the scene area, and a second position (as shown in FIG. 13D) that places the animated figure 202 out of the scene area.

The second mechanism 1304 is configured to maintain the free motion figure 502 at a location on the side of the wall 1310 opposite the animated figure 202 (as best shown in FIG. 13C). In one configuration, the second mechanism 1304 includes a pair of suspension cables 1326 attached at one end to the free motion figure 502 and the other end to a wheel assembly 1324. During rotation of the first mechanism 1302, the second mechanism 1304 rotates about the axis 1322 together with the first mechanism to maintain the free motion figure 502 at its location on the second portion 1318 of the base structure 1306.

Figure 13E:
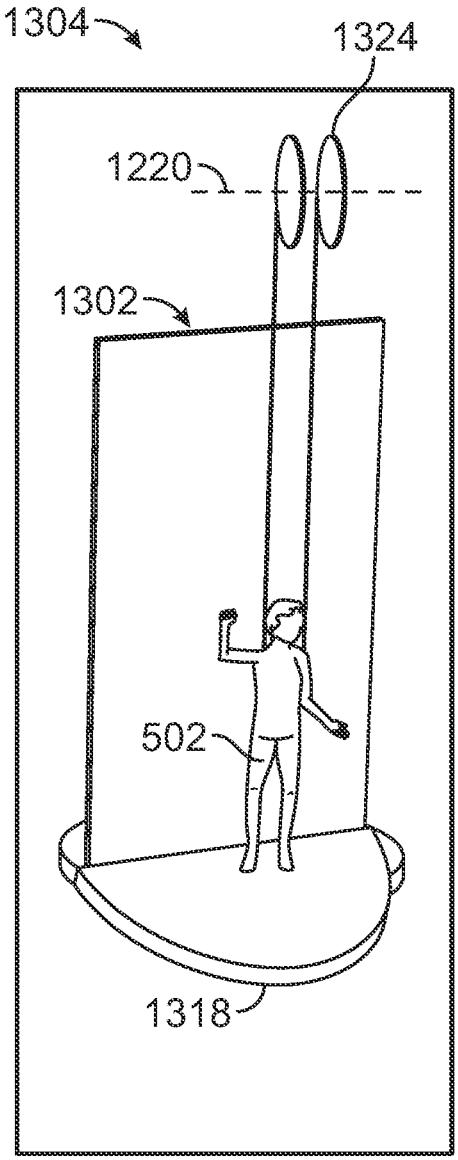
Figure 13F:
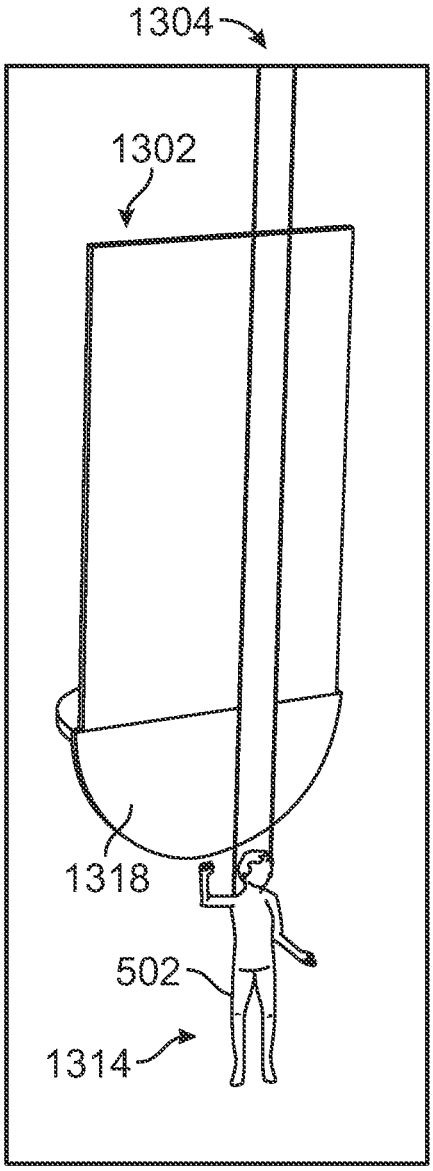

At the appropriate time and under the control of the ride controller 116, the first mechanism 1302 and the second mechanism 1304 release the free motion figure 502 to initiate a vertical free fall of the figure. More specifically, the second portion 1318 of the base structure 1306 drops (as shown in FIGS. 13E and 13F), while the wheel assembly 1324 of the second mechanism 1304 releases itself to freely or near-freely spin about the axis 1220, which in turn enables the free motion figure 502 to move to an outside location 1314 out of the scene area (as shown in FIG. 13F). Later, at the appropriate time during the ride and under the control of the ride controller 116, the process is reversed and the wheel assembly 1324 rotates about the axis 1220 to lift the free motion figure 502 from the outside location 1314 upward to a position near where the top surface of the second portion 1318 of the base structure 1306 will lie, and the second portion 1318 of the base structure 1306 is returned to its normal position (as shown in FIG. 13D).

Figure 14A:
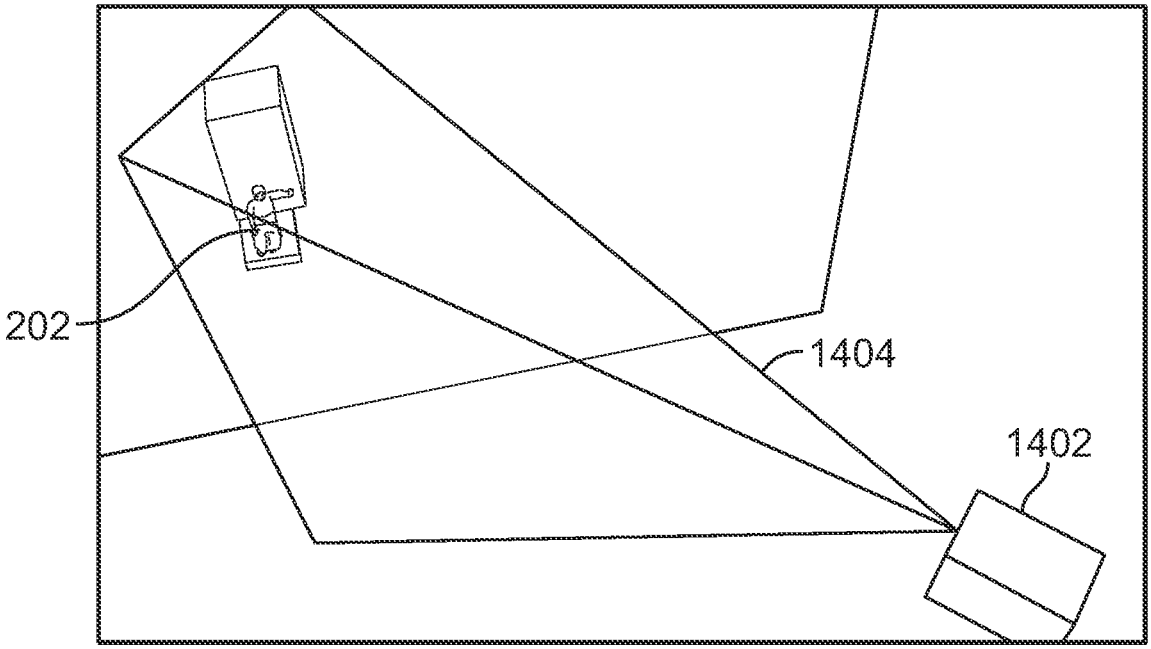
FIG. 14A-14C illustrate a projection system from illuminating an animated figure in a scene area and a free motion figure as it falls from a scene area.
Figure 14B:
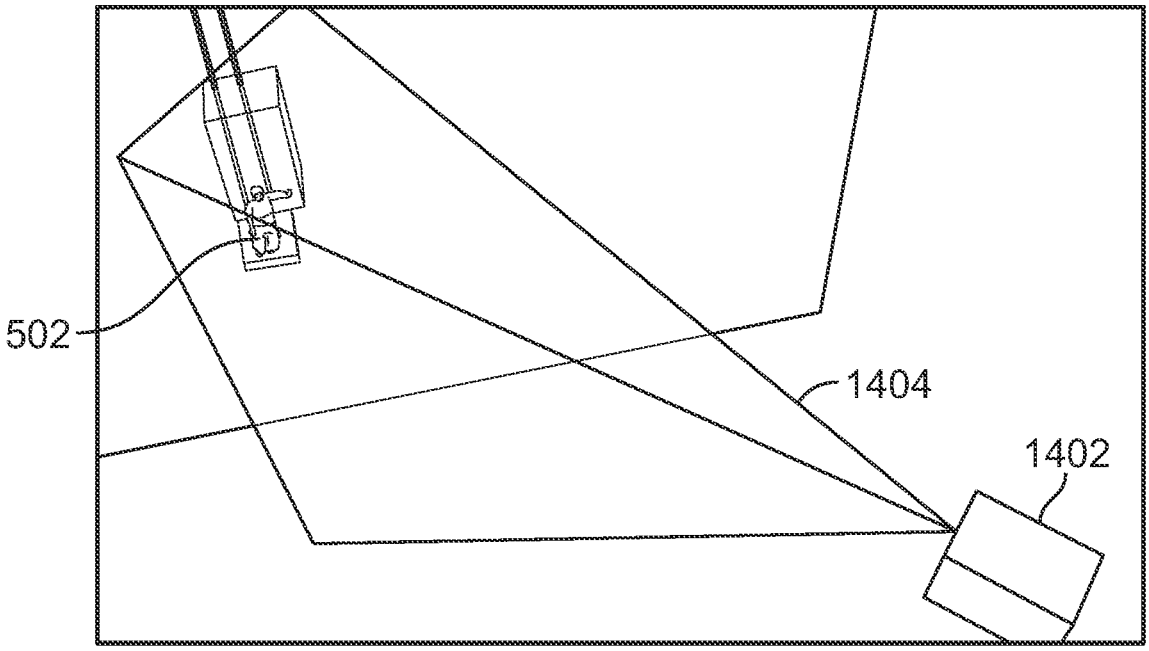
Figure 14C:
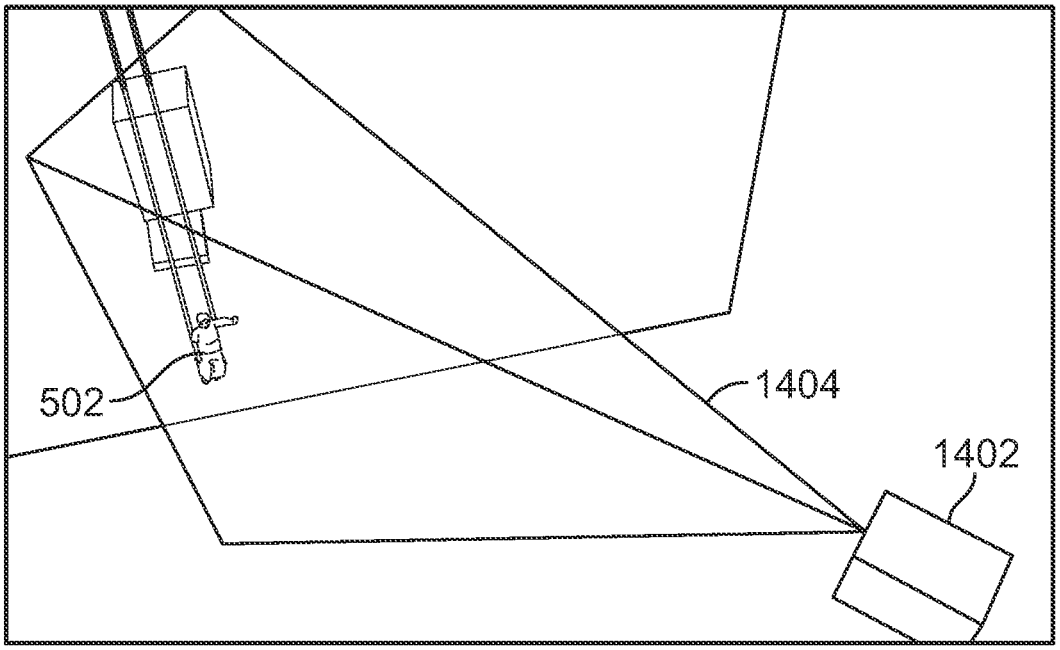

FIG. 14A-14C illustrate a projection system 1402 for casting light and shade on figures to give appearances of movements, such as facial expressions. In FIG. 14A a cone of light 1404 is projected by the projection system 1402 onto an animated figure 202 in the scene area. In FIG. 14B the same cone of light 1404 is projected by the projection system 1402 onto a free motion figure 502 that has been moved into the scene area in place of the animated figure. In FIG. 14C the same cone of light 1404 continues to be projected by the projection system 1402 onto free motion figure 502 while the free motion figure free falls out of the scene area.

Figure 15:
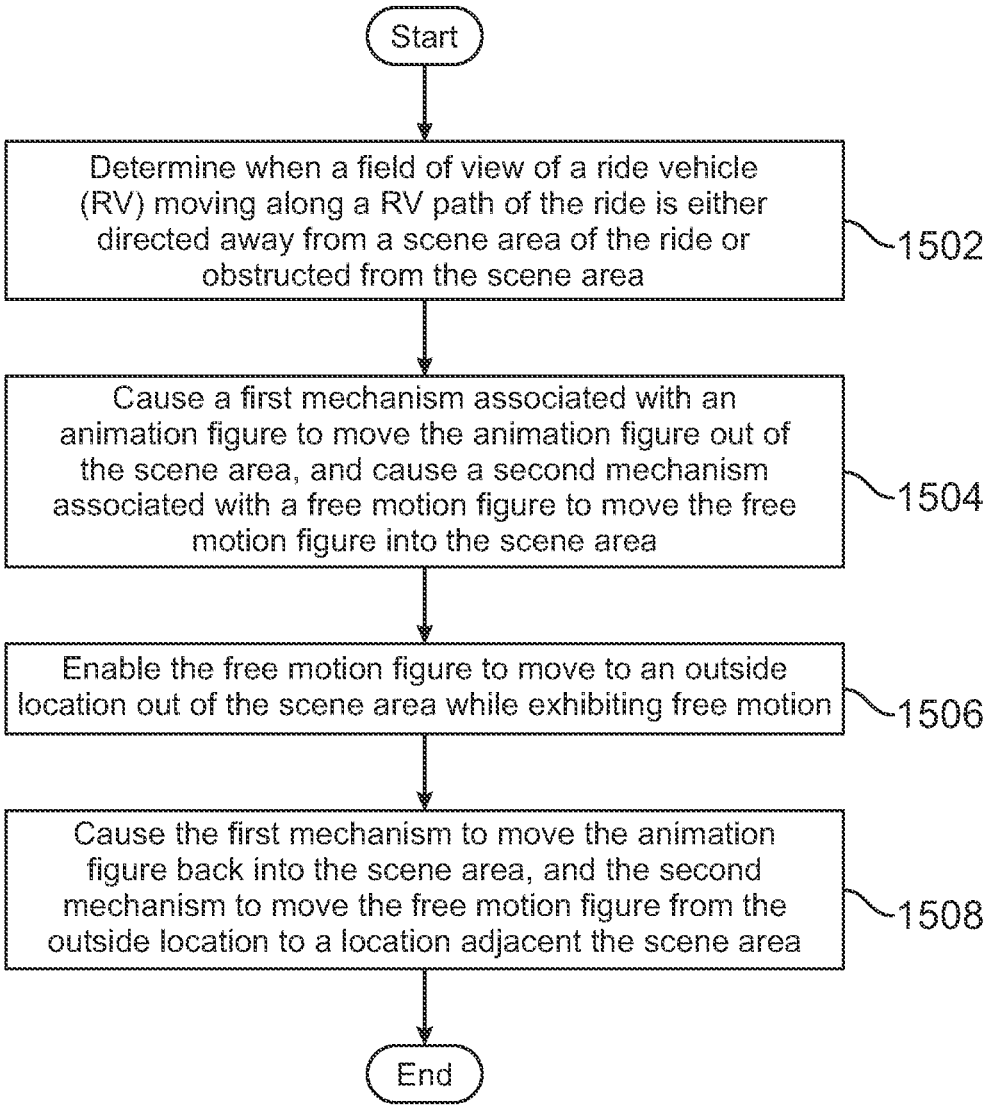
FIG. 15 is a flow chart of an exemplary process for repeatable switching between an animated figure and a free motion figure within a ride system.

FIG. 15 is a flow chart of an exemplary process for repeatable switching between an animated figure and a free motion figure within a ride system. The method may be performed by the amusement park system of FIG. 1 and one or more of the mechanisms of FIGS. 10A-13F.

At block 1502, a ride controller 116 determines when a field of view 106 of a ride vehicle 102 moving along an RV path 104 of the ride is either directed away from a scene area 110, 112 of the ride or obstructed from the scene area.

At block 1504, after determining that the field of view 106 is either directed away from a scene area 110, 112 or obstructed from the scene area, the ride controller 116 causes a first mechanism 1002 associated with a first figure, e.g., an animated figure 202, to move the animated figure out of the scene area. The ride controller 116 also causes a second mechanism 1004 associated with the second figure, e.g., a free motion figure 502, to move the free motion figure into the scene area.

At block 1506, subsequent to causing the second mechanism 1004 to move the free motion figure 502 into the scene area, the ride controller 116 enables the free motion figure to move to an outside location 1014 out of the scene area while exhibiting free motion.

At block 1508, subsequent to enabling the free motion figure 502 to move to the outside location 1014, the ride controller 116 causes the first mechanism 1002 to move the animated figure 202 back into the scene area, and the second mechanism 1004 to move the free motion figure 502 from the outside location 1014 to a first location 1012 adjacent the scene area.

As discussed herein, operations of the ride system 100 (FIG. 1) may be controlled utilizing a ride controller 116 and animated figures may be controlled utilizing an animation controller 118. Each of the ride controller 116 and the animation controller 118 may be any device employing a processor 120 (which may represent one or more processors), such as an application-specific processor. Each of the controllers 116, 118 may also include a memory device 122 storing instructions executable by the processor 120 to perform methods and control actions described herein relating to the ride system 100, the repeatable switching of an animated figure and a free motion figure, and the animation of the animated figures. The processors 120 may include one or more processing devices, and the memory devices 122 may include one or more tangible, non-transitory, machine-readable media. By way of example, such machine-readable media can include RAM, ROM, EPROM, EEPROM, optical disk storage, magnetic disk storage or other magnetic storage devices, or any other medium that can be used to carry or store desired program code in the form of machine-executable instructions or data structures and that can be accessed by the processors 120 or by any general purpose or special purpose computer or other machine with a processor.

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another—even if they do not directly physically touch each other. For instance, a first object may be coupled to a second object even though the first object is never directly physically in contact with the second object.

One or more of the components, steps, features and/or functions illustrated in FIGS. 1-15 may be rearranged and/or combined into a single component, step, feature or function or embodied in several components, steps, or functions. Additional elements, components, steps, and/or functions may also be added without departing from novel features disclosed herein. The apparatus, devices, and/or components illustrated in FIGS. 1-15 may be configured to perform one or more of the methods, features, or steps described herein. The novel algorithms described herein may also be efficiently implemented in software and/or embedded in hardware.

It is to be understood that the specific order or hierarchy of steps in the methods disclosed is an illustration of exemplary processes. Based upon design preferences, it is understood that the specific order or hierarchy of steps in the methods may be rearranged. The accompanying method claims present elements of the various steps in a sample order, and are not meant to be limited to the specific order or hierarchy presented unless specifically recited therein.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for."

What is claimed is:

1. An amusement park system, comprising:

a ride vehicle (RV) configured to move along an RV path, the ride vehicle having a field of view;

a first figure configured to animate within a scene area;

a first mechanism associated with the first figure, and configured to move the first figure into and out of the scene area;

a second figure configured to exhibit free motion;

a second mechanism associated with the second figure, and configured to move the second figure into and out of the scene area; and a ride controller configured to:

determine when the field of view of the RV is either directed away from the scene area or obstructed from the scene area, and responsive to such determination, cause the first mechanism to move the first figure out of the scene area and the second mechanism to move the second figure into the scene area.

2. The amusement park system of claim 1, wherein the first mechanism and the second mechanism are configured to operate in conjunction with each other to:

move the first figure out of the scene area, while the second figure is being moved into the scene area; or move the second figure out of the scene area, while the first figure is being moved into the scene area.

3. The amusement park system of claim 1, wherein the first mechanism comprises a base structure configured to:

support the first figure; and slide or rotate between a first position that places the first figure in the scene area, and a second position that places the first figure out of the scene area.

4. The amusement park system of claim 3, wherein the first mechanism comprises a structure configured to impede visibility of the first figure while the first figure is out of the scene area.

5. The amusement park system of claim 4, wherein the structure is one of a wall or a box.

6. The amusement park system of claim 3, wherein the second mechanism comprises a structure configured to:

suspend the second figure at a first location out of the scene area, move the second figure to an inside location of the scene area, and enable the second figure to move to an outside location out of the scene area while exhibiting free motion.

7. The amusement park system of claim 1, wherein:

the first mechanism comprises a base structure having a first portion configured to support the first figure and a second portion configured to support the second figure, the second portion further configured to transition its orientation relative to the first portion between a first plane generally common with a plane of the first portion, and a second plane that is not common with the plane of the first portion, and the first mechanism and the second mechanism are configured to rotate between respective first positions that place the first figure in the scene area and the second figure out of the scene area, and respective second positions that place the second figure in the scene area and the first figure out of the scene area.

8. The amusement park system of claim 7, wherein the base structure comprises a wall located between the first figure and the second figure.

9. The amusement park system of claim 7, wherein the second mechanism further comprises structure configured to:

enable the second figure to move from an inside location of the scene area to an outside location out of the scene area when the second portion of the base structure transitions from the first plane to the second plane; and subsequently move the second figure from the outside location to the inside location.

10. The amusement park system of claim 1, wherein the ride controller is configured to determine when the field of view of the RV is either directed away from the scene area or blocked from the scene area based on one or more of:

an expiration of a timer from a start of movement by the RV, an activation of a sensor by the RV at or near the scene area, or an expiration of a timer activated by a detection of the RV at a point along the RV path.

11. The amusement park system of claim 1, wherein the first figure is coupled to an animation controller configured to cause the first figure to animate.

12. The amusement park system of claim 11, wherein the ride controller controls the animation controller so that the first figure animates only while the first figure is in the scene area.

13. The amusement park system of claim 1, further comprising a projection system configured to project light onto the second figure while the second figure is in the scene area and at least a portion of time while the second figure moves out of the scene area.

14. The amusement park system of claim 1, wherein the first figure and the second figure have a same appearance.

15. A method of controlling a first figure configured to animate and a second figure configured to exhibit free motion in an amusement park ride, the method comprising:

determining when a field of view of a ride vehicle (RV) moving along a RV path of the ride is either directed away from a scene area of the ride or obstructed from the scene area, and responsive to such determination, causing a first mechanism associated with the first figure to move the first figure out of the scene area, and causing a second mechanism associated with the second figure to move the second figure into the scene area.

16. The method of claim 15, further comprising:

subsequent to causing the second mechanism to move the second figure into the scene area, enabling the second figure to move to an outside location out of the scene area while exhibiting free motion.

17. The method of claim 16, further comprising:

subsequent to enabling the second figure to move to an outside location out of the scene area, causing the first mechanism to move the first figure back into the scene area, and causing the second mechanism to move the second figure from the outside location to a location adjacent the scene area.

* * * * *